US005408446A

United States Patent [19]

Ohira

[11] Patent Number: 5,408,446

[45] Date of Patent: Apr. 18, 1995

[54] STOPWATCH WITH TARGET TIME FUNCTION

[75] Inventor: Tatsuo Ohira, Akishima, Japan

[73] Assignee: Casio Computer Co., Ltd., Tokyo, Japan

[21] Appl. No.: 176,703

[22] Filed: Jan. 3, 1994

Related U.S. Application Data

[62] Division of Ser. No. 646,827, Jan. 28, 1991, Pat. No. 5,297,110.

[30] Foreign Application Priority Data

Jan. 31, 1990 [JP] Japan ..... 2-8794 U

[51] Int. Cl.[6] ..... G04F 8/00

[52] U.S. Cl. ..... 368/110; 368/113

[58] Field of Search ..... 368/107-113

[56] References Cited

U.S. PATENT DOCUMENTS

| | | | |
|---|---|---|---|
| 3,876,767 | 4/1975 | Schull et al. | 368/111 |
| 3,876,867 | 4/1975 | Schull et al. . | |
| 4,094,135 | 6/1978 | Nomura et al. . | |
| 4,094,135 | 6/1978 | Nomura et al. | 368/111 |
| 4,262,352 | 4/1981 | Kobayashi et al. . | |
| 4,355,380 | 10/1982 | Huguenin et al. | 368/71 |
| 4,510,185 | 4/1985 | Tahara | 368/111 |
| 4,510,485 | 4/1985 | Tahara . | |
| 4,640,624 | 3/1987 | Pitt . | |
| 4,657,405 | 4/1987 | Nakazawa . | |
| 4,831,605 | 5/1989 | Suga . | |
| 4,831,605 | 5/1989 | Suga | 368/111 |
| 4,901,294 | 2/1990 | Aihara . | |
| 4,901,294 | 2/1990 | Aihara | 368/111 |
| 4,991,156 | 2/1991 | Suga . | |
| 5,050,141 | 9/1991 | Thinesen | 368/110 |
| 5,130,957 | 7/1992 | Nakabayashi | 368/110 |
| 5,151,885 | 9/1992 | Kasuo | 368/110 |
| 5,173,856 | 12/1992 | Purnell et al. | 364/551.01 |
| 5,257,245 | 10/1993 | Thinesen | 368/70 |

*Primary Examiner*—Bernard Roskoski

*Attorney, Agent, or Firm*—Frishauf, Holtz, Goodman & Woodward

[57] ABSTRACT

In a stopwatch of this invention, when a lap switch is operated after time measurement is started, a lap time from the immediately preceding lap switch operation to the current lap switch operation is stored and compared with a measurement time after the current lap switch operation. Since an alarm tone is generated if the measurement time after the current lap switch operation coincides with the stored lap time, the immediately preceding lap time can be used as a target time of the time measurement. The stopwatch can be conveniently used when a running speed is increased or decreased in each lap in a track race or the like.

9 Claims, 10 Drawing Sheets

STOPWATCH WITH TARGET TIME FUNCTION

This is a division of application Ser. No. 07/646,827, filed Jan. 28, 1991, now U.S. Pat. No. 5,297,111 issued Mar. 22, 1994.

BACKGROUND OF THE INVENTION

1. Field of the Invention

The present invention relates to a stopwatch for measuring an elapsed time and, more particularly, to a stopwatch capable of storing a target time in a memory and providing an alarm when the elapsed time is close to or reaches the target time.

2. Description of the Related Art

A stopwatch having a target time function capable of setting a target time and generating an alarm when a measurement time reaches the target time or displaying a time difference between target and measurement times has been conventionally developed. For example, U.S. Pat. No. 4,831,605 describes a stopwatch of this type. Although an arbitrary target time can be set in such a stopwatch, the target time must be key-input and stored in a memory by operating target time input keys.

Even when a target time is set beforehand, however, a measurement result obtained by actual time measurement is sometimes largely different from the target time.

For example, although a user is apt to run 10 km in 40 minutes, it sometimes takes 60 minutes for him or her to run 10 km because a lot of slopes are present. In this case, the user must correct the target value before he or she runs next time. In order to set a target time in a conventional stopwatch, however, a user must record first measurement data in a notebook or the like, set the stopwatch in a target time set mode, and then key-input the target time while checking the measurement data recorded on the notebook or the like.

In a motor car race, for example, since cars run around the same racing course a number of times, pit crews must give instructions about, e.g., an increase and decrease in a speed, a delay, and an order to a driver or prepare for gas replenishment or tire exchange for each lap. If it can be predicted that it takes three minutes, for example, for a motor car to run the circuit once, a timing in which the car passes before a pit can be determined on the basis of a target time of three minutes. If, however, the car is in good condition and can run faster, it may pass the pit at a speed of less than three minutes per lap. In this case, the target time must be reset. Otherwise, the pit crews sometimes fail to give the various instructions as described above or may require a long time in gas replenishment or tire exchange because a preparation time is short.

In a conventional stopwatch with a target time function, however, a target time must be set beforehand by a key-input operation, resulting in a very cumbersome target time set operation.

SUMMARY OF THE INVENTION

The present invention has been made in consideration of the above situation and has as its object to provide a stopwatch capable of inputting and changing a target time of the stopwatch without performing a cumbersome input operation.

In order to achieve the above object of the present invention, there is provided a stopwatch comprising: time measuring means for starting time measurement in accordance with a start command to obtain measurement time information; display means for displaying the measurement time information obtained by the time measuring means; operation switching means to be operated during the time measurement performed by the time measuring means; measurement time information storing means having a plurality of time information storage areas for sequentially storing the measurement time information obtained by the time measuring means each time the operation switching means is operated; comparing means for comparing time information based on lastly stored measurement time information of a plurality of measurement time information stored in the plurality of time information storage areas of the measurement time information storing means with time information based on current measurement time information measured by the time measuring means to detect a coincidence therebetween; and alarming means for alarming that the coincidence is detected by the comparing means.

With the above arrangement, since the latest measured time information can be used as a target time with respect to time information currently being measured, a target time need not be set by a switch operation or the like, and the next measurement timing can be easily predicted.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

FIGS. 1 to 3 are views showing the first embodiment of the present invention, in which FIG. 1 is a block diagram showing a circuit arrangement of a stopwatch according to the present invention, and FIGS. 2 and 3 are views showing display contents of the stopwatch shown in FIG. 1;

FIGS. 4 to 6 are views showing the second embodiment of the present invention, in which FIG. 4 is a block diagram showing a circuit arrangement, and FIG. 5 and 6 are views showing display contents thereof; and FIGS. 7 to 14 are views showing the third embodiment of the present invention, in which FIG. 7 is a block diagram showing a circuit arrangement of an electronic wristwatch according to the present invention, FIG. 8 is a view showing an arrangement of a RAM shown in FIG. 7, FIG. 9 is a view showing an outer appearance of a display portion of the electronic wristwatch shown in FIG. 7, FIG. 10 is a general flow chart for explaining an operation of the third embodiment, FIG. 11 is a flow chart for explaining switch processing shown in FIG. 10 in detail, FIG. 12 is a flow chart for explaining hand moving processing shown in FIG. 10 in detail, FIG. 13 is a flow chart showing display processing shown in FIG. 10 in detail, and FIG. 14 is a view showing changes in positions of hands during lap measurement.

DETAILED DESCRIPTION OF THE PREFERRED EMBODIMENTS

[1st Embodiment]

The first embodiment of the present invention will be described below with reference to the accompanying drawings.

Figure 1:
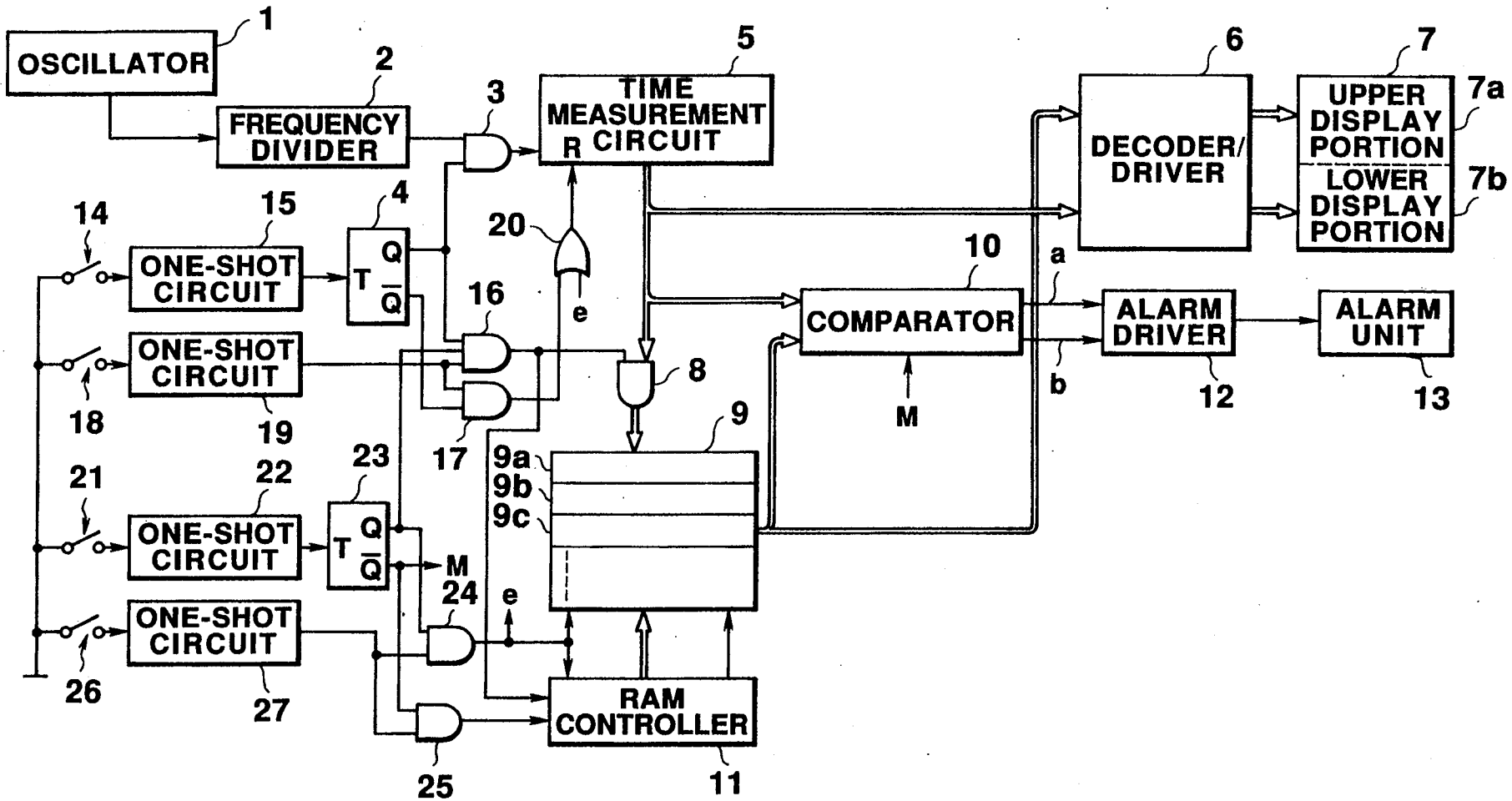

FIG. 1 is a block diagram showing a circuit arrangement of a stopwatch of the present invention.

Referring to FIG. 1, a quartz oscillator 1 outputs an oscillation frequency signal having a frequency of 32,768 Hz. The frequency signal output from the oscillator 1 is frequency-divided into a pulse signal having a frequency of 100 Hz by a frequency divider 2 and supplied to one input terminal of an AND gate 3. The other input terminal of the AND gate 3 receives a signal from the set output terminal Q of a flip-flop circuit 4 (to be described later), and the 100-Hz pulse signal output from the AND gate 3 is supplied to a time measurement circuit 5.

Figure 2:
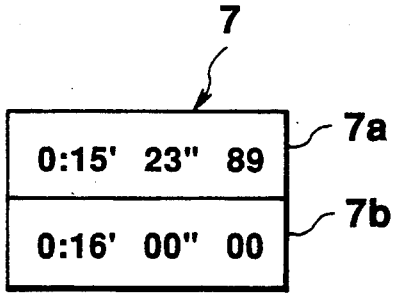

The time measurement circuit 5 measures an elapsed time on the basis of the pulse signal supplied via the AND gate 3. Time measurement data obtained by the time measurement circuit 5 is output to and decoded by a decoder/driver 6 and displayed on a lower display portion *7b* of a liquid crystal display unit 7. The display unit 7 is divided into two portions by using liquid crystal display elements as shown in FIG. 2, in which an upper display portion *7a* displays target time data and the lower display portion *7b* displays the measurement time data. The measurement time data from the time measurement circuit 5 is also supplied to a RAM (Random Access Memory) 9 via an AND gate 8 and to a comparator 10.

The RAM 9 has a large number of time storage areas *9a, 9b, 9c*, . . . , and sequentially stores the measurement time data measured by the time measurement circuit 5, i.e., a split time measured after the measurement is started, in the storage areas each time an operation switch 18 (to be described later) is operated. An area to be used to store the data is address-designated by a RAM controller 11. Each split time stored in the RAM 9 is read out in accordance with the address designation performed by the RAM controller 11, supplied to the comparator 10 and the decoder/driver 6, and displayed on the upper display portion *7a* of the display unit 7.

The comparator 10 compares the measurement time data supplied from the time measurement circuit 5 with the storage time data (split time) read out from the RAM 9. If the comparator 10 detects that the measurement time data from the circuit 5 reaches a predetermined time, e.g., one minute before the storage time data, it outputs a first alarm signal a to an alarm driver 12. If the time measurement data from the circuit 5 coincides with the storage time data from the RAM 9, the comparator 10 outputs a second alarm signal b to the alarm driver 12.

The alarm driver 12 drives an alarm unit 13 to generate alarm tones having different tone colors in accordance with the first and second alarm signals.

A start/stop switch 14 is an external operation switch for starting/stopping the measurement operation performed by the time measurement circuit 5 and has a switch output terminal connected to a one-shot circuit 15. The one-shot circuit 15 outputs a one-shot pulse signal in response to a signal input by an operation of the start/stop switch 14 and supplies the output signal to the trigger input terminal T of the flip-flop circuit 4.

The set output terminal Q of the flip-flop circuit 4 is connected to the other input terminal of the AND gate 3 and to the first input terminal of an AND gate 16. The inversion output terminal $\overline{Q}$ of the flip-flop 10 circuit 4 is connected to one input terminal of an AND gate 17.

The split switch 18 is used to store the measurement time data obtained by the time measurement circuit 5 as a split time from the start of time measurement in the RAM 9 during the measurement and to reset (clear) the circuit 5 while the time measurement is stopped. An output from the split switch 18 is supplied to a one-shot circuit 19. The circuit 19 outputs a one-shot pulse signal in accordance with an operation of the split switch 18 and supplies the signal to the third input terminal of the AND gate 16 and the other input terminal of the AND gate 17. The output terminal of the AND gate 16 is connected as an increment signal to the other input terminal of the AND gate 8 and the RAM controller 11.

The output terminal of the AND gate 17 is connected to one input terminal of an OR gate 20, and the output terminal of the OR gate 20 is connected to a reset terminal R of the time measurement circuit 5. Therefore, when the split switch 18 is operated in a stop state in which no measurement operation is performed and a signal of level "1" is output from the inversion output terminal $\overline{Q}$ of the flip-flop circuit 4, the time measurement circuit 5 is reset.

A mode switch 21 is used to perform switching between a split time storage mode and a split time check mode. An output from the mode switch 21 is supplied to a one-shot circuit 22. The circuit 22 outputs a one-shot pulse signal in accordance with an operation of the mode switch 21 and supplies the signal to the trigger input terminal T of a flip-flop circuit 23.

The output terminal Q of the flip-flop circuit 23 is connected to the second input terminal of the AND gate 16 and one input terminal of an AND gate 24. While a signal of level "1" is output from the output terminal Q of the flip-flop circuit 23, the "split time storage mode" is set, and the AND gates 16 and 24 are enabled to make it possible to store the measurement time data obtained by the time measurement circuit 5 into the RAM 9.

The signal of level "1" output from the inversion output terminal $\overline{Q}$ of the flip-flip circuit 23 is also supplied to the control terminal of the comparator 10 as a comparison instruction signal M and one input terminal of an AND gate 25. While the signal of level "1" is output from the inversion output terminal $\overline{Q}$ of the flip-flop circuit 23, therefore, since the "split time check mode" is set, the comparator 10 is operated and the AND gate 25 is enabled.

An address update switch 26 is used to update (increment) an address of the RAN 9 to address-designate one of the time storage areas *9a, 9b, 9c*, . . . An output from the switch 26 is supplied to a one-shot circuit 27. The one-shot circuit 27 outputs a one-shot pulse signal in accordance with an operation of the address update switch 26 and supplies the signal to the other input terminal of each of the AND gates 24 and 25.

An output from the AND gate 24 is supplied to the other input terminal of the OR gate 20 as a reset signal e and to the RAM 9 and the RAM controller 11 as a write address update signal. An output signal from the AND gate 25 is supplied to the RAM controller 11 as a read address update signal.

An operation of the above first embodiment will be described below.

First, a signal of level "1" output from the output terminal Q of the flip-flop circuit 23 is supplied to the second input terminal of the AND gate 16 and one input terminal of the AND gate 24. In addition, the time measurement circuit 5 is already reset to have measurement data of "0:00'00"00 (0 hr.00 min.00 sec.00)".

When the start/stop switch 14 is operated in this state, the time measurement circuit 5 starts a time measurement operation. That is, one-shot pulse signal is supplied from the one-shot circuit 15 to the flip-flop circuit 4, and a signal of level "1" is output from the output terminal Q. As a result, the AND gate 3 is enabled to allow the frequency divider 2 to supply a 100-Hz pulse signal to the time measurement circuit 5, thereby starting the measurement operation. In addition, since the signal of level "1" is supplied to each of the first and second input terminals of the AND gate 16, the AND gate 16 is allowed to receive an input signal from the split switch 18.

When a user is running, for example, he or she operates the split switch 18 to store a "split time" in the RAM 9 each time he or she passes a check point. In this case, the "split time" is an elapsed time from the start of measurement.

when the split switch 18 is operated, a one-shot pulse signal from the one-shot circuit 19 is supplied to the third input terminal of the AND gate 16 and one input terminal of the AND gate 17. At this time, the AND gate 16 is enabled, and the AND gate 17 is disabled. Therefore, the AND gate 16 supplies the input one-shot pulse signal to the AND gate 8 and the RAM controller 11.

As a result, the AND gate 8 is enabled to write current measurement time data (e.g., "0:15'23"89" as a "first split time") of the time measurement circuit 5 in the first time storage area 9*a* of the RAM 9. After the measurement time data is written, the RAM controller 11 updates a to-be-designated address of the RAM 9 by "+1" so that the next split time can be written in the next storage area 9*b*.

When the runner continuously performs the measurement operation and passes the next check point, he or she operates the split switch 18 again to set the second split time. As a result, as described above, the AND gate 16 supplies a one-shot pulse signal to the AND gate 8, and current measurement time data (e.g., "0:31"12'23") measured by the time measurement circuit 5 is written in the time storage area 9*b* of the RAM 9 as a "second split time". Thereafter, the RAM controller 11 updates the to-be-designated address of the RAM 9 by "+1" so that the next split time can be stored in the next storage area 9*c*.

In this manner, a split time is sequentially stored in the RAM 9 each time the split switch 18 is operated. Note that in order to stop the measurement, the start/stop switch 14 is operated again to invert the output from the flip-flop circuit 4. In order to clear the measurement data of the time measurement circuit 5, the switch 18 is operated in the measurement stop state.

An operation in which each split time stored in the RAM 9 is used as a target time will be described. First, the mode switch 21 is operated. As a result, the flip-flop circuit 23 is inverted to switch the split time storage mode to the split time check mode, and a signal of level "1" is output from the inversion output terminal $\overline{Q}$ and supplied to the AND gate 25 and to the comparator 10 as a comparison instruction signal M.

Subsequently, the address update switch 26 is operated in order to select the first split time stored in the time storage area 9*a*. As a result, a one-shot pulse signal is supplied to the other input terminal of each of the AND gates 24 and 25. Since the AND gate 24 is disabled, however, only the AND gate 25 outputs the one-shot pulse signal to the RAM controller 11. As a result, the address of the RAM 9 is updated. At this time, the contents in a storage area of the RAM 9 address-designated by the RAM controller 11 are supplied to the decoder/driver 6 and displayed on the upper display portion 7*a* of the display unit 7.

Assuming that the first time storage area 9*a* of the RAM 9 is designated, the first split time "0:15'23"89" stored in the area 9*a* is output to the decoder/driver 6 and to the comparator 10 as target time data.

As a result, the first split time "0:15'23"89" is displayed on the upper display portion 7*a* as shown in FIG. 2.

In this state, the start/stop switch 14 is operated to cause the time measurement circuit 5 to start a second measurement operation. As a result, a pulse signal from the frequency divider 2 is supplied to the time measurement circuit 5 to start the measurement operation.

when the measurement time reaches "0:14'23"89", i.e., a time one minute before the target time, the comparator 10 outputs the first alarm signal a to the alarm driver 12. As a result, the alarm driver 12 outputs a first drive signal to the alarm unit 13. The alarm unit 13 generates a first alarm tone on the basis of the first drive signal.

when the measurement time of the time measurement circuit 5 reaches "0:15'23"89", i.e., coincides with the target time output from the RAM 9, the comparator 10 outputs the second alarm signal b to the alarm driver 12. As a result, the alarm driver 12 outputs a second driver signal to the alarm unit 13. The alarm unit 13 generates a second alarm tone having a tone color different from that of the first alarm tone on the basis of the second driver signal.

If the runner passes the check point at a split time longer than the first split time measured by the first measurement, the first target time "0:15'23"89" is displayed on the upper display portion 7*a*, and the measurement time "0:16'00"00" is displayed on the lower display portion 7*b*, as shown in FIG. 2. In order to set the second split time stored in the second time storage area 9*b* of the RAM 9 as the next target time, therefore, the address update switch 26 is operated.

As a result, the to-be-designated address of the RAM controller 11 is updated by "+1" to designate the second time storage area 9*b* of the RAM 9, and the second split time ("0:31'12"23") stored in the second time storage area 9*b* is output to the decoder/driver 6 and to the comparator 10 as the next target time data.

Figure 3:
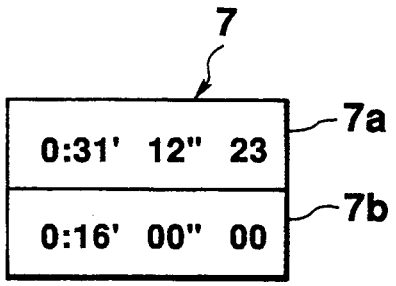

As a result, as shown in FIG. 3, the second split time "0:31'12"23" is displayed on the upper display portion 7*a*, and the measurement time "0:16'00"00" obtained by the time measurement circuit 5 is display on the lower display portion 7*b*.

Subsequently, as in the same manner as described above, when the measurement time reaches a time period one minute before the second split time ("0:31'12"23") and the measurement time coincides with the second split time, the comparator 10 detects this and the first and second alarm tones are generated.

In addition, each time the address update switch 26 is operated, the split times stored in the time storage area 9*c* and the subsequent areas of the RAM 9 are sequentially displayed and compared as the target times.

In the first embodiment as described above, since the split switch 18 is operated to sequentially store split times in the RAM 9 in the first measurement, the stored split times can be easily set as target time data by only sequentially operating the address update switch 26 in the second measurement.

[2nd Embodiment]

The second embodiment of the present invention will be described below.

Figure 4:
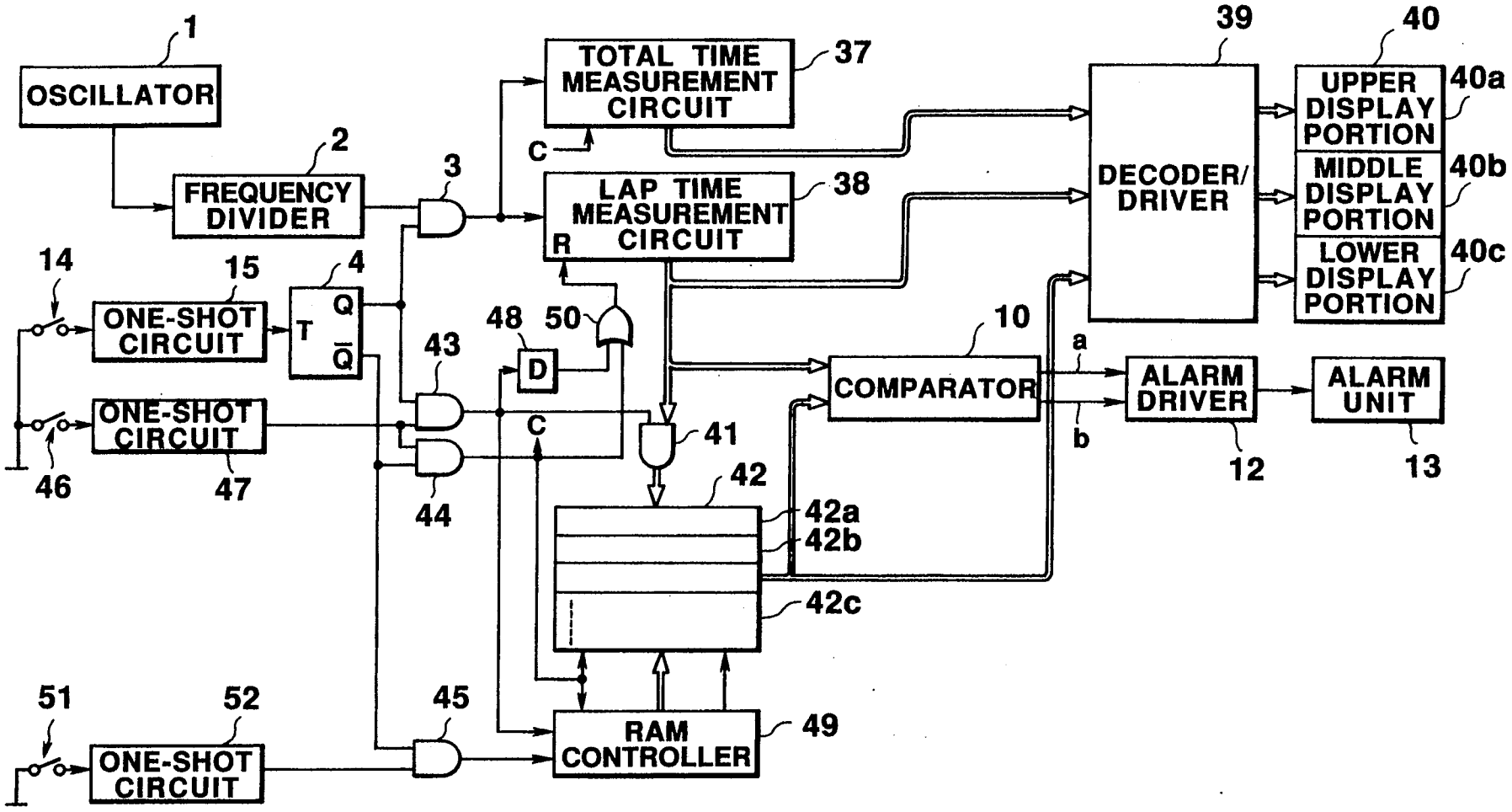

FIG. 4 is a block diagram showing a circuit arrangement of a stopwatch according to the present invention. Note that in FIG. 4, the same reference numerals as in FIG. 1 denote the same parts and a detailed description thereof will be omitted.

Referring to FIG. 4, a pulse signal output from a quartz oscillator 1 is frequency-divided into a 100-Hz pulse signal by a frequency divider 2 and supplied to one input terminal of an AND gate 3. While a signal of level "1" is output from the output terminal Q of a flip-flop circuit 4, the pulse signal output from the frequency divider 2 is supplied to a total time measurement circuit 37 and a lap time measurement circuit 38 via an AND gate 3.

The total time measurement circuit 37 measures a current total time from the start of measurement on the basis of the pulse signal supplied via the AND gate 3. Measurement time data of the circuit 37 is output to a decoder/driver 39 and displayed on an upper display portion 40*a* of a display unit 40 (to be described later).

The lap time measurement circuit 38 measures a measurement time in a predetermined section (e.g., from points A to B) during the measurement operation, i.e., a lap time from the immediately preceding operation to the current operation of a lap switch 46 (to be described later) on the basis of the pulse signal supplied via the AND gate 3. The measurement data of the lap time measurement circuit 38 is output to the decoder/driver 39 and displayed on a middle display portion 40*b* of the display unit 40. The measurement data of the circuit 38 is also output to a lap time storage RAM 42 via an AND gate 41 and to a comparator 10.

The lap time storage RAM 42 sequentially stores the lap times measured by the lap time measurement circuit 38 and input via the AND gate 41. The RAM 42 is constituted by a large number of lap time storage areas 42*a*, 42*b*, 42*c*, . . . , for storing the lap times and address-designated by a RAM controller 49. Each lap time stored in the lap time storage RAM 42 is read out in accordance with the address designation performed by the RAM controller 49 and output to the comparator 10. The lap time is also output to the decoder/driver 39 and displayed on a lower display portion 40*c* of the display unit 40. Note that the lap time storage RAM 42 for storing the lap time is used as a target time storage memory as will be described later and can store a plurality of lap times. Therefore, the-RAM 42 can also be used simply as a lap time memory.

The comparator 10 compares the measurement data supplied from the lap time measurement circuit 38 with the storage data read out from the lap time RAM 42. When the measurement data of the circuit 38 reaches a time one minute before the storage data read out from the RAM 42, the comparator 10 outputs a first alarm signal a to an alarm driver 12. When the measurement data coincides with the storage data, the comparator 10 outputs a second alarm signal b to the alarm driver 12.

The alarm driver 12 drives an alarm unit 13 to generate alarm tones having different tone colors in accordance with the first and second alarm signals a and b.

As in the first embodiment described above, a start/stop switch 14 is used to start/stop the measurement operations performed by the total time measurement circuit 37 and the lap time measurement circuit 38. An output from the switch 14 is supplied to a one-shot circuit 15. The circuit 15 outputs a one-shot pulse signal to the trigger input terminal T of a flip-flop circuit 4.

The output terminal Q of the flip-flop circuit 4 is connected to the other input terminal of the AND gate 3 and one input terminal of an AND gate 43. The inversion output terminal $\overline{Q}$ of the circuit 4 is connected to one input terminal of an AND gate 44 and one input terminal of an AND gate 45.

The lap switch 46 is used to store the measurement time data obtained by the lap time measurement circuit 38 in the lap time RAM 42 and reset the lap time RAM 42 during the time measurement, and to reset the total time measurement circuit 37, the lap time measurement circuit 38, and the RAM 42 while the measurement is stopped. An output from the lap switch 46 is supplied to a one-shot circuit 47. The circuit 47 outputs a one-shot pulse signal in accordance with an operation of the lap switch 46 and supplies the signal to the other input terminal of the AND gate 43 and the other input terminal of the AND gate 44.

The output terminal of the AND gate 43 is connected to the other input terminal of the AND gate 41, a delay circuit 48, and the RAM controller 49. An output from the delay circuit 48 is supplied to the reset terminal of the lap time measurement circuit 38 via an OR gate 50. When a one-shot pulse signal is input, the RAM controller 49 increments a to-be-designated address of the lap time RAM 42 by "+1".

When the lap switch 46 is operated during the time measurement, the address of the lap time RAM 42 is updated by the signal from the one-shot circuit 47, and the measurement time data of the lap time measurement circuit 38 is written in the address-designated area of the lap time RAM 42. The above one-shot pulse signal is output from the delay circuit 48 with a predetermined delay time and input to the reset terminal R of the lap time measurement circuit 38 via the OR gate 50, thereby resetting the circuit 38.

Thereafter, the RAM controller 49 sends the written measurement time data to the comparator 10 as a target time. As a result, the lap time written in the RAM 42 is compared as a target time of the next lap time with the measurement data of the lap time measurement circuit 38.

An output from the AND gate 44 is supplied as a reset signal C to the reset terminal of the total time measurement circuit 37 and the reset terminal R of the lap time measurement circuit 38 via the OR gate 50. The output from the AND gate 44 is also input to the lap time RAM 42 and the RAM controller 49, thereby resetting and initializing the RAM 42 and the RAM controller 49.

An address update switch 51 is used to sequentially update the read address of the lap time RAM 42 while the time measurement is stopped. An output from the switch 51 is supplied to a one-shot circuit 52. The circuit 52 outputs a one-shot signal in accordance with an operation of the address update ! switch 51 and supplies the signal to the other input terminal of the AND gate 45. An output from the AND gate 45 is supplied to the RAM controller 49 so that the read address of the RAM controller 49 is updated by "+1" by the above one-shot signal.

An operation of the second embodiment will be described below.

In this embodiment, a "lap time" is measured in a race of running around the same course.

First, a runner operates the start/stop switch 14 at the same time he or she starts running, thereby starting the measurement operations performed by the total time measurement circuit 37 and the lap time measurement circuit 38, Note that the circuits 37 and 38 are already reset and "0:00'00"00" is set as measurement data in each circuit.

In response to the operation of the start/stop switch 14, a one-shot pulse signal is input to the flip-flop circuit 4, and a signal of level "1" is output from the output terminal Q. As a result, the AND gate 3 is enabled to supply a pulse signal from the frequency divider 2 to the total time measurement circuit 37 and the lap time measurement circuit 38, thereby performing the time measurement operations of the respective circuits. In addition, since the signal of level "1" is supplied to one input terminal of the AND gate 43, an input signal from the lap switch 46 can be received. Note that since a signal of level "0" is output from the inversion output terminal $\overline{Q}$ of the flip-flop circuit 4, the AND gate 44 is disabled.

Figure 5:
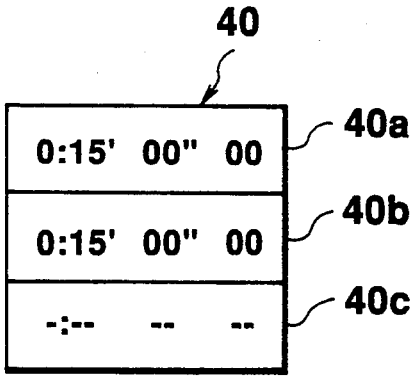

During the measurement operation, the measurement data of the total time measurement circuit 37 and the lap time measurement circuit 38 are output to the decoder/-driver 39 and displayed on the upper and middle display portions 40*a* and 40*b* as shown in FIG. 5. In this case, since no "lap time" is set yet, the circuits 37 and 38 have the same measurement data.

Subsequently, when the runner passes the start point after one lap, he or she operates the lap switch 46. As a result, a one-shot pulse signal obtained in accordance with the operation of the switch 46 is supplied to the other input terminals of the AND gates 43 and 44. In this case, since the AND gate 43 is enabled and the AND gate 44 is disabled, only the AND gate 43 outputs the one-shot pulse signal and supplies the signal to the AND gate 41, the delay circuit 48, and the RAM controller 49.

As a result, the measurement data (e.g., "0:15'00"00") of the lap time measurement circuit 38 is written as a first lap time $L_1$ in the first lap time storage area 42*a* of the lap time RAM 42. The first lap time $L_1$ written in the area 42*a* of the RAM 42 is read out in accordance with address designation performed by the RAM controller 49 and output to the comparator 10. The first lap time is also output to the decoder/driver 39 and displayed on the lower display portion 40*c* of the display unit 40 as a target time. The lap time measurement circuit 38 is reset by a signal output from the delay circuit 48 with a predetermine delay time to start the next lap time measurement operation.

Figure 6:
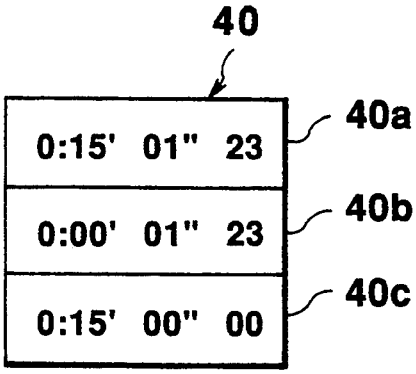

For example, if the lap switch 46 is operated at a time exactly 15 minutes after the start of measurement and one second and 23 have elapsed from then on, the measurement data "0:15'01"23" of the total time measurement circuit 37 is displayed on the upper display portion 40*a*, the measurement data "0:0'01"23" of the lap time measurement circuit 38 is displayed on the middle display portion 40*b*, and the first lap time $L_1$ read out from the first lap time storage area 42*a* of the lap time RAM 42 is displayed as a target time on the lower display portion 40*c*, as shown in FIG. 6.

That is, in this embodiment, an immediately preceding lap time is set as a target time in the next lap measurement.

When the measurement data of the lap time measurement circuit 38 reaches "0:14'00"00" i.e., a time one minute before the target time, the comparator 10 outputs the first alarm signal a to the alarm driver 12. Therefore, the alarm driver 12 outputs a first drive signal to the alarm unit 13, and the alarm unit 13 generates a first alarm tone on the basis of the first drive signal.

when the measurement data of the lap time measurement circuit 38 reaches "0:15'00"00", i.e., coincides with the target time output from the lap time RAM 42, the comparator 10 outputs a second alarm signal b to the alarm driver 12. Therefore, the alarm driver outputs a second drive signal to the alarm unit 13, and the alarm unit 13 generates a second alarm tone having a tone color different from the first alarm tone on the basis of the second drive signal.

when the runner continuously performs the measurement operation and passes the start point after two laps, he or she operates the lap switch 46. In response to the operation of the switch 46, the AND gate 43 supplies a one-shot signal to the AND gate 41, the delay circuit 48, and the RAM controller 49. Therefore, the RAM controller 49 address-designates the second lap time storage area 42*b* of the RAM 42 and stores the lap time in this address-designated area 42*b*.

As a result, the measurement data (e.g., "0:15'20"00") of the lap time measurement circuit 38 is written as a second lap time $L_2$ in the second area 42*b* of the lap time RAM 42. Under the control of the RAM controller 49, the second lap time $L_2$ written in the lap time RAM 42 is read out and output to the comparator 10 and is also output to the decoder/driver 39 and displayed on the lower display portion 40*c* as a target time.

In addition, the lap time measurement circuit 38 is reset by a signal output from the delay circuit 48 with a predetermined delay to start the next lap time measurement.

As described above, in this second embodiment, a currently measured lap time is stored in the lap time RAM 42 and automatically set as target time data for the next lap measurement each time the lap switch 46 is operated. Therefore, this stopwatch is very convenient when the running speed of a user is gradually increased or decreased in each lap.

Although the comparator compares the measurement data with the stored data in the first and second embodiments, the data may be compared by using an arithmetic circuit. In addition, the timing of alarming using the alarm tone may be arbitrarily set at any timing before a target time.

The stopwatch may further include an arithmetic means for performing an arithmetic operation between a target time and a measurement time to calculate a time difference and a display means for displaying the calculation result. This display means may also display the number of operation times of the split switch and the lap switch. The present invention can be carried out by using a ROM and a RAM under the control of a microcomputer.

Although the data is displayed on two or three display portions in the above embodiments, the data may be displayed by switching a display screen, and a display type is not limited to a digital display but may be a analog display using hands. In addition, a split time or a lap time may be stored in an area different from that storing a target time so that the two times can be simultaneously displayed each time measurement is stopped.

Furthermore, switches such as the start/stop switch, the split switch, and the lap switch need not be push-button switches as used in the above embodiments but may be switches which output switch signals in response to a voice, a vibration, or the like.

The stopwatch of the present invention need not be an exclusive stopwatch but may be incorporated in an electronic wristwatch or a clock. In addition, the alarm tone need not be an electronic tone generated by a buzzer or a loudspeaker, but a voice generated by a voice synthesizer may be used to inform a remaining time before a target time or reaching of the target time.

Furthermore, a set switch for setting a target time in advance may be provided to manually input and set a target time.

[3rd Embodiment]

Figure 7:
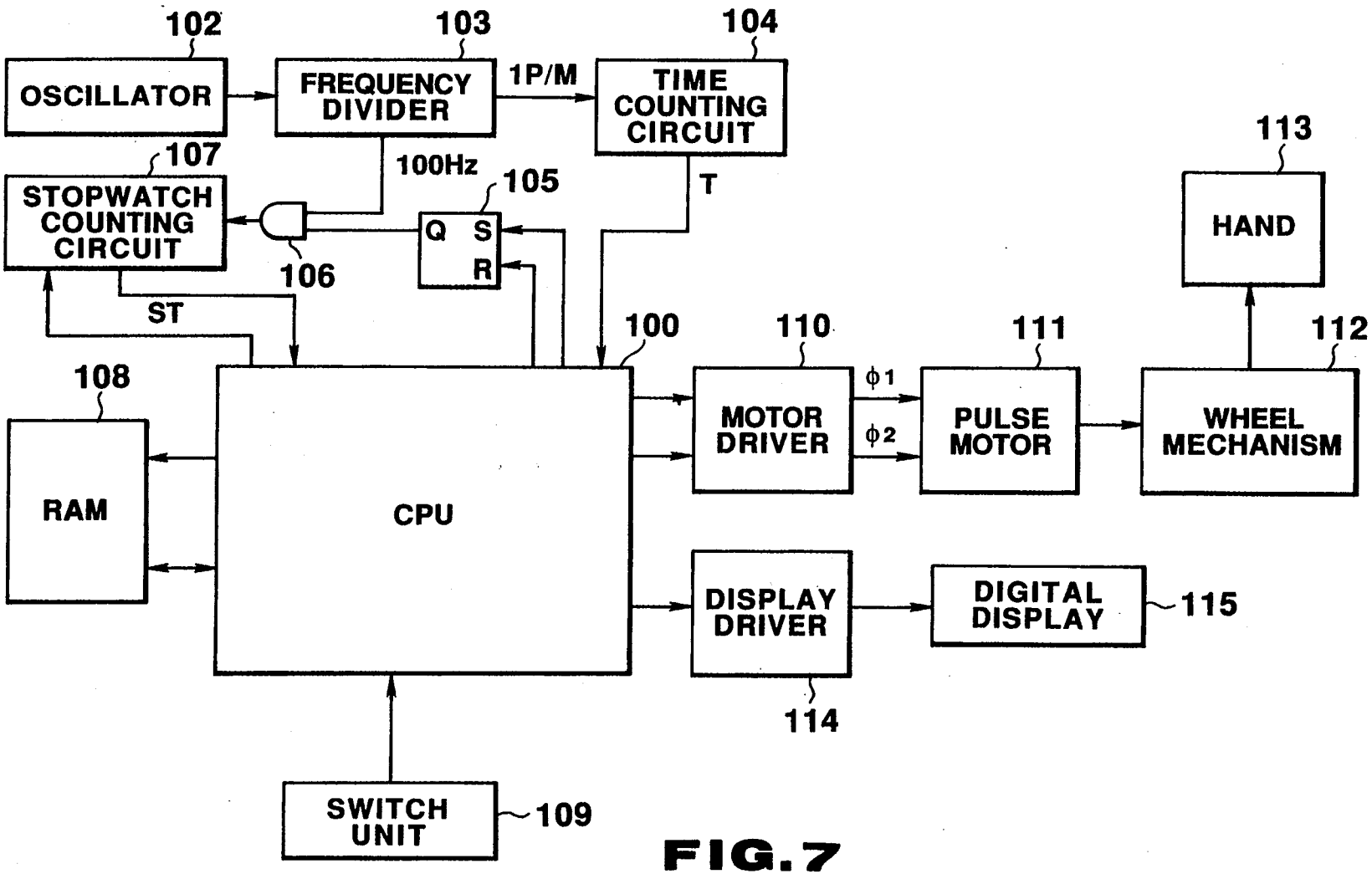

FIGS. 7 to 14 show the third embodiment of the present invention, in which FIG. 7 shows a circuit arrangement of this embodiment. That is, in this embodiment, a CPU 100 is used as a central unit, and other peripheral circuits are connected to the CPU 100. The CPU 100 sends control signals to the other circuits to control the circuits and processes and outputs data supplied therefrom.

An oscillator 102 constantly outputs a signal having a predetermined frequency, and a frequency divider 103 frequency-divides the signal output from the oscillator 102 to form a signal having a period of one minute (1-P/M signal) and a 100-Hz signal. The frequency divider 103 supplies the former signal to a time counting circuit 104 and the latter signal to an AND gate 106. The time counting circuit 104 counts the supplied 1-P/M signals to obtain current time information T and supplies the information T to the CPU 100.

An RS flip-flop 105 is set or reset in accordance with a set or reset signal from the CPU 100 and supplies a set output Q to the AND gate 106 in a set state. The AND gate 106 is enabled by the output Q and sends the 100-Hz signal from the frequency divider 103 to a stopwatch counting circuit 107. The counting circuit 107 counts the supplied 100-Hz signals to obtain a stopwatch time ST and supplies the time ST to the CPU 100. In addition, the counting circuit 107 clears the counted stopwatch time ST in accordance with a clear signal from the CPU 100.

A RAM 108 stores data supplied from the CPU 100 and sends the stored data to the CPU 100 under the control of the CPU 100. A switch unit 109 includes a large number of switches. When one of the switches is operated, the switch unit 109 supplies a corresponding switch input signal to the CPU 100.

A motor driver 110 receives a control signal from the CPU 100 and sends drive signals $\Phi_1$ and $\Phi_2$ to a pulse motor 111, thereby driving the motor 111. A rotational force of the motor 111 is transmitted to hands 113 via a gear train or wheel mechanism 112 used to move the hands 113. A display driver 114 displays the stopwatch time ST supplied from the CPU 100 on a digital display 115 including a liquid crystal display panel. The display 115 is driven by the display driver 114 to display the stopwatch time ST on the liquid crystal display panel.

Figure 8:
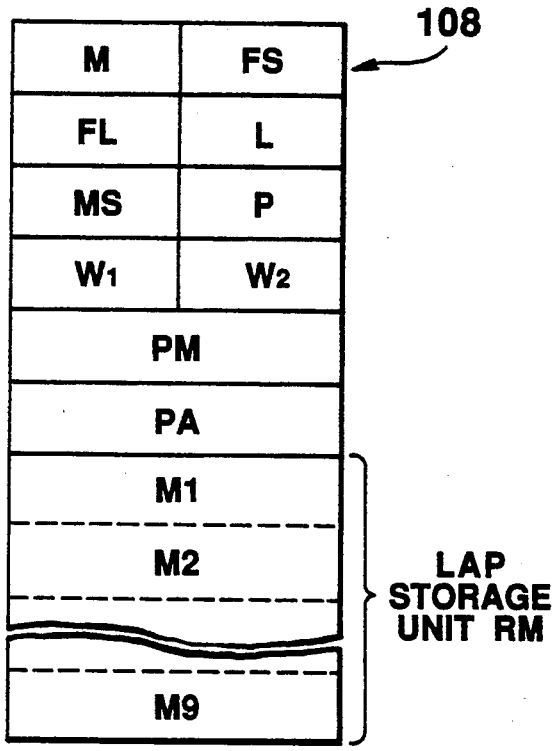

FIG. 8 shows an arrangement of the RAM 108. A mode register M is used to designate a mode. When "0" is set in the register M, the register M designates a timepiece mode for displaying a current time T by using the hands 113. When "1" is set in the register M, the register M designates a measurement mode for performing measurement as a stopwatch. When "2" is set in the register M, the register M designates a read mode for reading out a lap measured in the above measurement mode and stored in a lap storage unit RM (to be described later). A measurement flag FS is set to "1" when measurement as a stopwatch is started in the measurement mode and reset to "0" when the measurement is finished. A lap prediction flag FL is set when an immediately preceding lap time is 10 seconds or more and an operation of predicting the next lap measurement timing is to be performed. A lap number register L stores the number of lap measurement operations which are already performed. A drive period register MS stores a hand step-driving period performed to predict the next lap timing. A memory designation register P designates one of lap memories M1 to M9 of the lap storage unit RM. For example, when "2" is set in the register P, the register P designates the lap memory M2. Working registers $W_1$ and $W_2$ are used to measure a lap. A hand position storage register PM stores position number data from "0" to "719" assigned to respective position of the hands 113 such that 0:00′="0", 0:01′="1"0:02′="2"11:59′="719", thereby storing the positions of the hands 113. A fast movement position storage register PA stores the position number data in order to designate a final fast movement positions of the hands 113 when the hands 113 are to be moved fast.

The lap storage unit RM is constituted by the lap memories M1 to M9, and first, second, third, . . . , ninth laps are sequentially stored in each of the lap memories M1 to M9.

Figure 9:
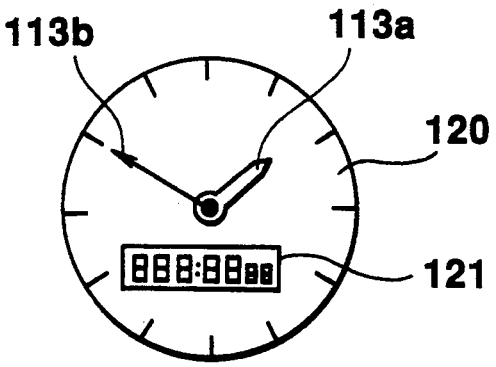

FIG. 9 shows an outer appearance of a display unit of an electronic wristwatch according to this embodiment. That is, an hour hand 113a, a minute hand **113*b*, and a liquid crystal display panel 121 are arranged on a face 120, and seven-segment display members of seven digits for displaying the stopwatch time ST are disposed in the panel 121**.

An operation of this embodiment having the above arrangement will now be described.

Figure 10:
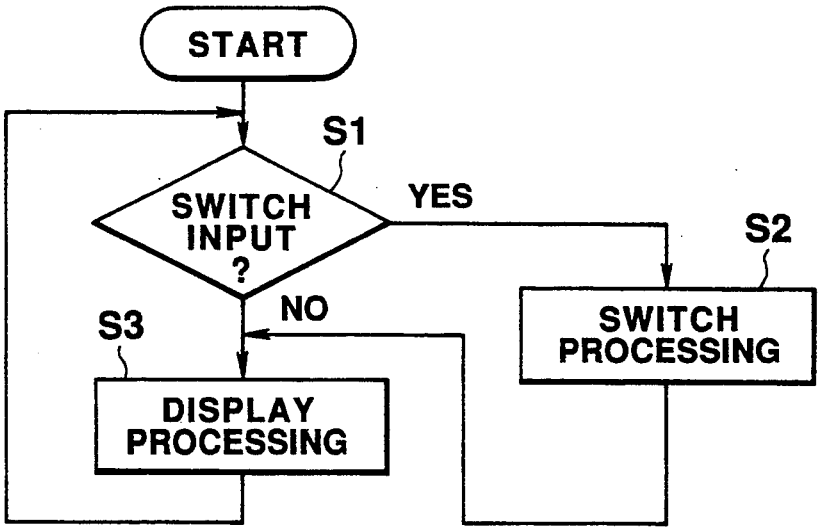

FIG. 10 is a general flow chart for briefly explaining an operation of the above embodiment. That is, the CPU 100 checks in step S1 whether a switch input is present. If a switch input is present in step S1, the flow advances to step S2 to execute switch processing and then advances to display processing in step S3. If no-switch input is present in step S1, the flow directly advances from step S1 to S3, and various types of data are displayed. When the display processing is finished, the flow returns to step S1.

Figure 11:
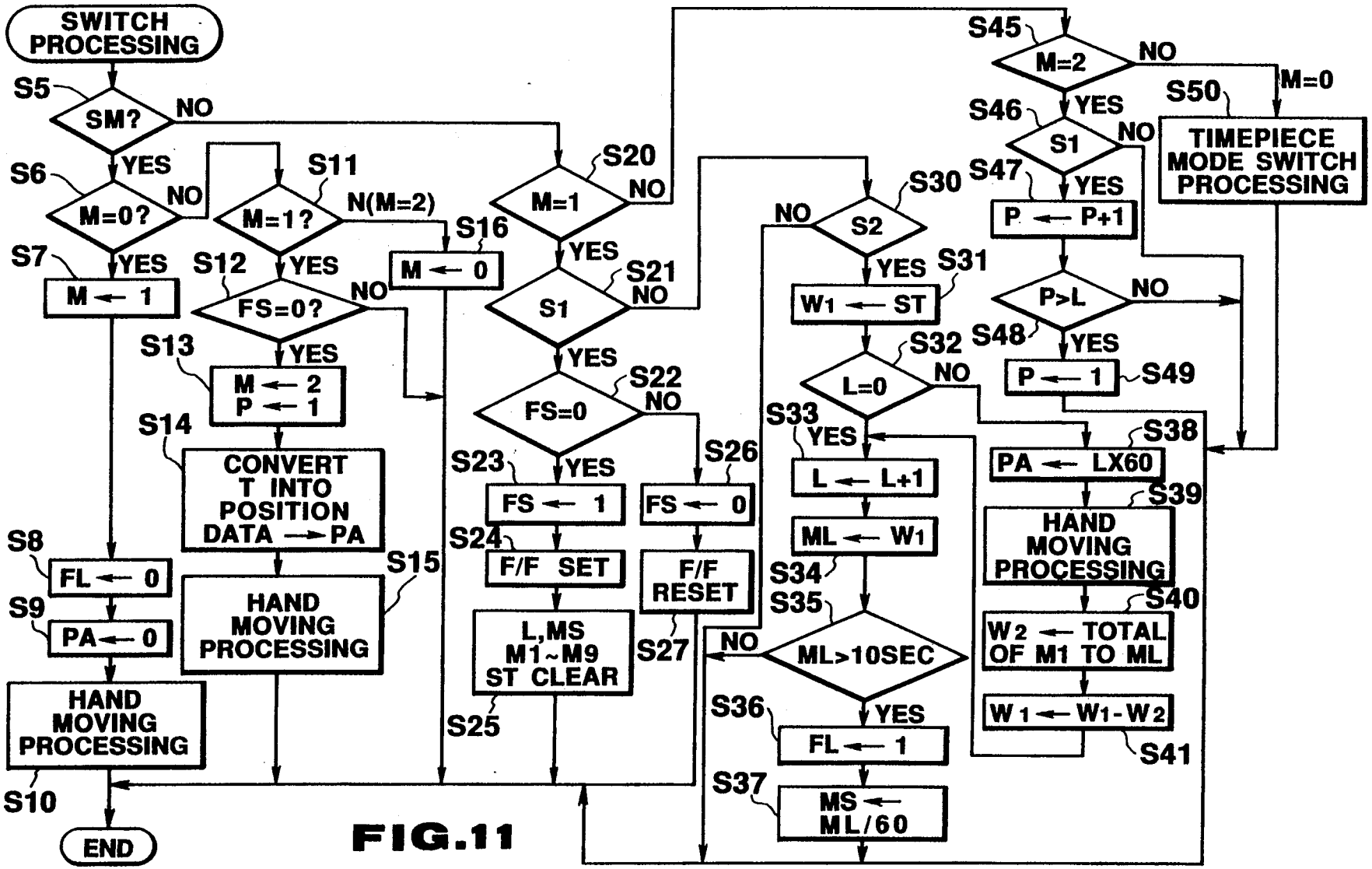
Figure 12:
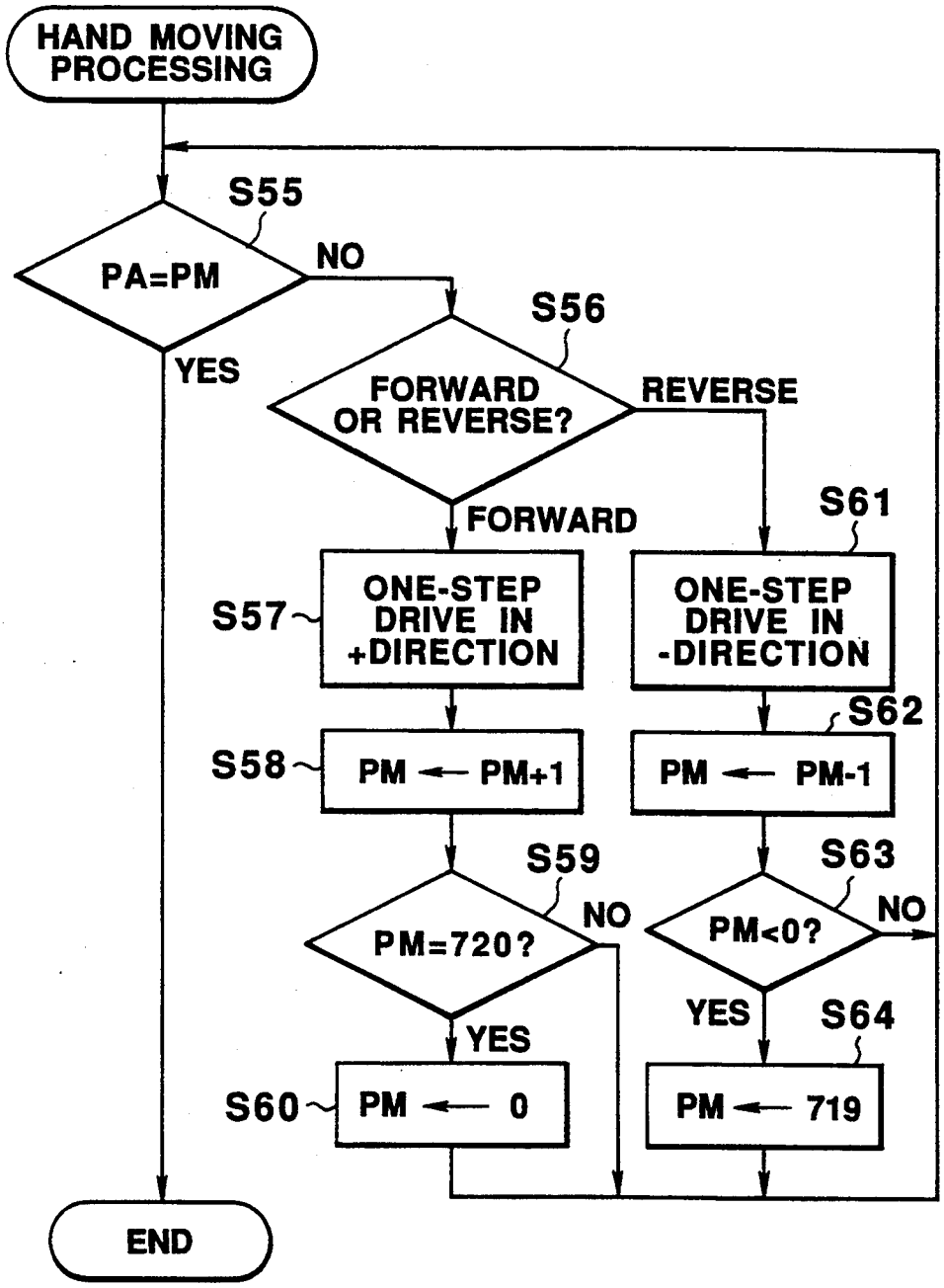
Figure 13:
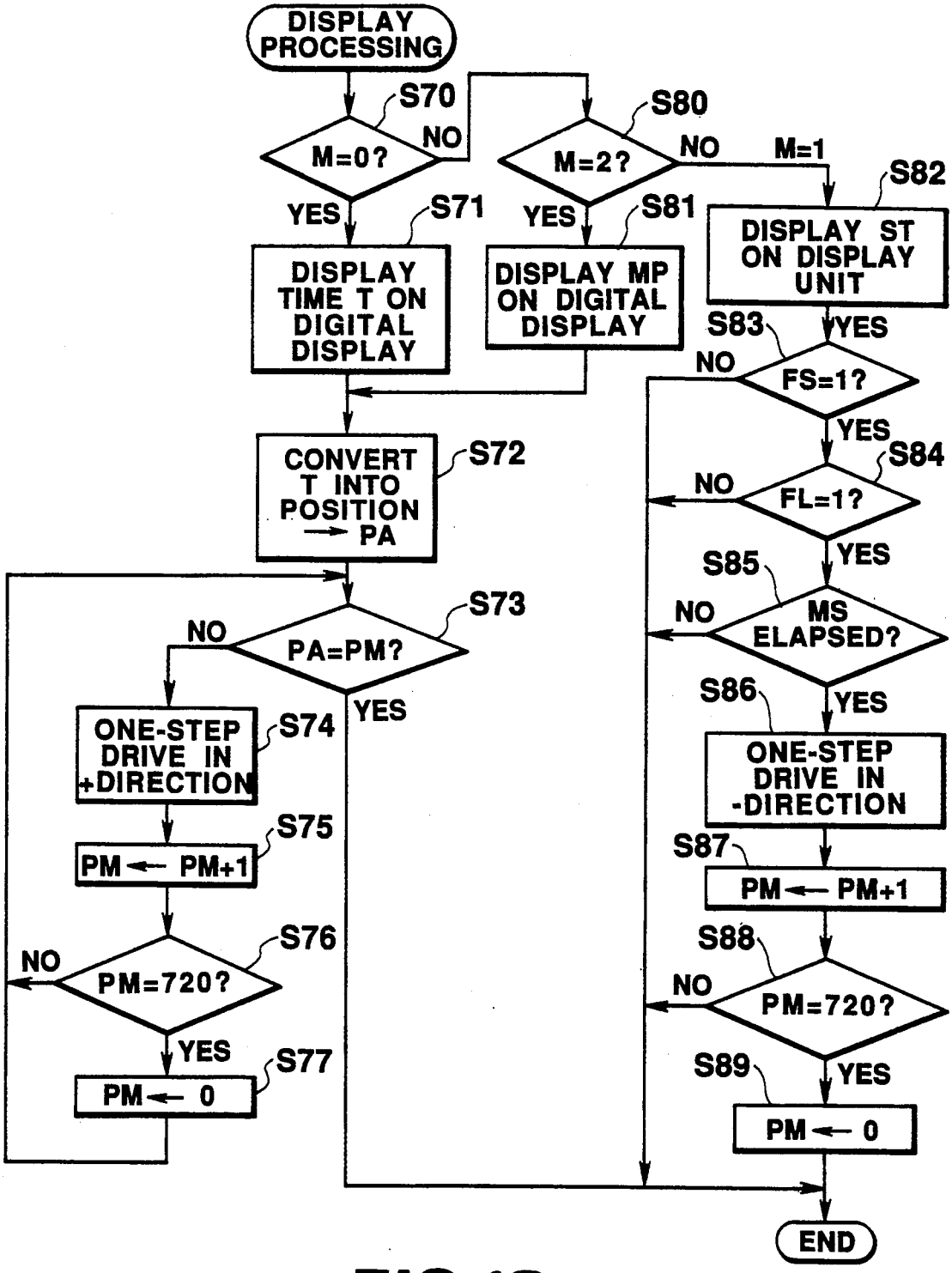
Figure 14:
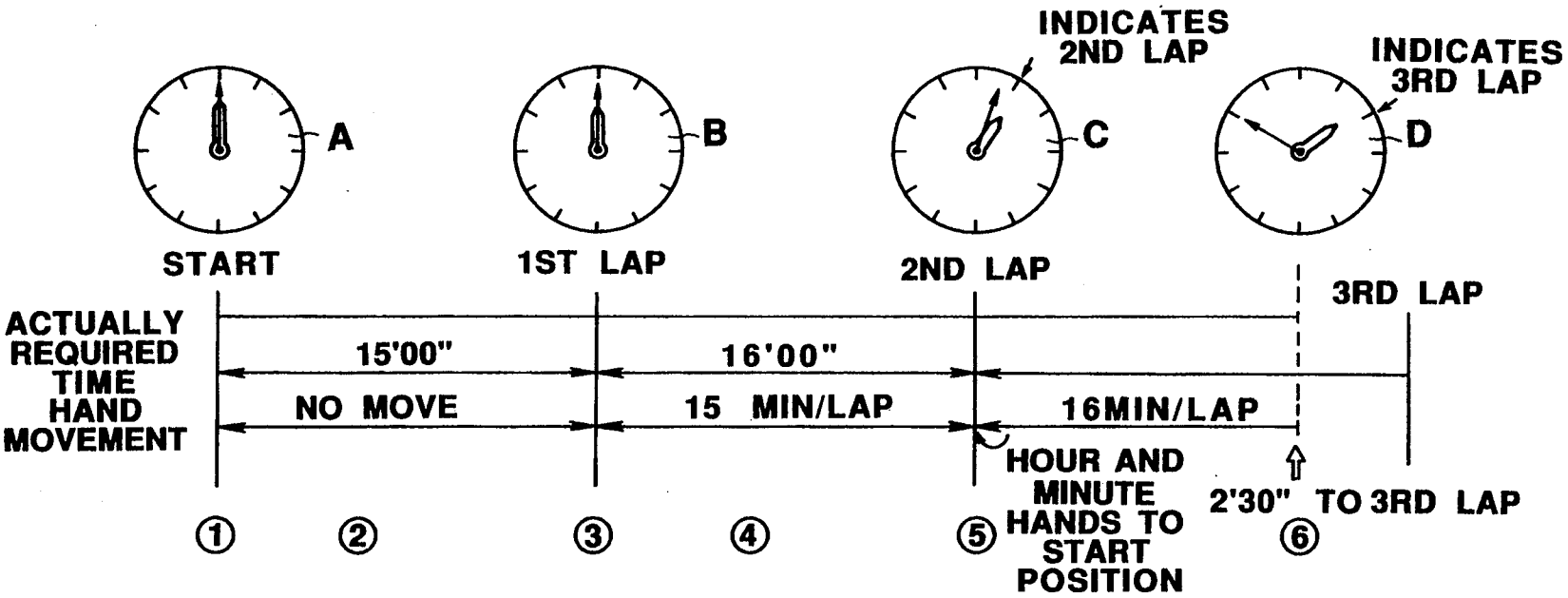

FIG. 11 is a flow chart showing in detail the switch processing shown in the general flow chart of FIG. 10, and FIG. 12 is a flow chart showing in detail hand moving processing executed in each of steps S10, S15, and S39 (to be described later) shown in the flow chart of FIG. 11. FIG. 13 is a flow chart showing in detail the display processing in step S3 of the general flow chart, and FIG. 14 is a view showing movements of the hour and minute hands **113*a* and 113*b*** obtained when lap measurement is performed in the measurement mode described above. An operation in each processing will be described below with reference to a corresponding drawing.

For example, assume that "0" is set in the mode register M to set the timepiece mode. In order to switch the timepiece mode to the measurement mode to use the device as a stopwatch, the mode switch SM is operated. This operation of the mode switch SM is detected in step S5 shown in FIG. 11. In step S6, the CPU 100 checks whether the mode switch SM is operated in the timepiece mode, i.e., when M=0. If the CPU 100 determines in step S6 that the switch SM is operated in the timepiece mode (M=0), the CPU 100 sets "1" in the mode register M to set the measurement mode in step S7. The lap prediction flag FL is reset in step S8, the fast movement position storage register PA is cleared in step S9, and the flow advances to the hand moving processing in step S10. In this hand moving processing in step S10, the hands 113 are moved fast to a position designated by the fast movement position storage register PA. That is, as shown in FIG. 12, the CPU 100 checks in step S55 that position number data of the hand position storage register PM, i.e., the position of the hands is equal to position number data (which is set to be "0" in the processing in step S9) of the fast movement position storage register PA. If N (NO) in step S55, the flow advances to step S56, and the CPU 100 checks whether the hands can reach the position designated by the fast movement position storage register PA faster by the forward or reverse direction. In step S57 or S61, the hands are driven fast step by step in the direction in which they can reach the position faster. In step S58 or S62, the movement position of the hands is stored in the hand position storage register PM each time the hands are moved by one step. In this case, the position number data corresponding to 0:00′ is either "0" or "720". Therefore, when the position number data set in the hand position storage register PM reaches "720" along the forward direction, this movement is detected in step S59, and "0" is set in the hand position register PM in step S60. When the data reaches "0" along the reverse direction, this movement is detected in step S63, and the position number data of the hand position storage register PM is preset to be "719" in step S64. When the position number data of the hand position storage register PM coincides with the position number data of the fast movement position storage register PA in this manner, this coincidence is detected in step S55, and the hand moving processing is ended. That is, when the mode switch SM is operated in the timepiece mode (M=0), M=1 is set in step S7 to set the measurement mode. In addition, the position data of the fast movement position storage register PA is set to be "0", i.e., position data corresponding to 0:00′ is set in step S9, and the hands 113 are located in a position indicating 0:00′ in step S10 as shown by state "A" in FIG. 14. As a result, the value of the hand position storage register PM is also set to be "0" indicating 0:00′.

In the display processing shown in step S3 of Fig. 10, as shown in FIG. 13 in detail, "NO" is determined in each of steps S70 and S80 since M=1, and the flow advances to step S82 to display the stopwatch time ST from the stopwatch counting circuit 107 on the liquid crystal display panel 121 of the digital display 115. In this case, 0:00,00″ is displayed because measurement is not performed yet, and the CPU 100 determines in step S83 that the measurement flag FS is reset, thereby ending the display processing.

In order to start the measurement mode after the measurement mode (M=1) is set as described above, the switch $S_1$ is operated. This operation of the switch $S_1$is detected in step S21 via steps S5 and S20 in FIG. 11, and the CPU 100 determines in step S22 that the measurement flag FS is not set yet. The CPU 100 sets the measurement flag FS in step S23 and sends a set signal to the RS flip-flop 105 to set the flip-flop 105 in step S24, thereby causing the stopwatch counting circuit 107 to start measurement of the stopwatch time ST. In step S25, initialize processing is executed to clear the lap number register L, the drive period register MS, the lap memories M1 to M9, and the stopwatch time ST. In the display processing shown in FIG. 13, the stopwatch time ST from the stopwatch counting circuit 107 is displayed on the liquid crystal display panel 121 in step S82, and the CPU 100 determines in step S83 that the measurement flag FS is set and checks in step S84 whether the lap prediction flag FL is set. At this time, since the flag FL is not set yet, the display processing is ended.

Thereafter, the switch input detecting processing (step S1) and the display processing (step S3) in the general flow charts are repeatedly executed as time elapses and a current stopwatch time ST is sequentially displayed on the liquid crystal display panel 121. The hands 113, however, are not moved but maintained in state "A" as shown in FIG. 14.

When the first lap measurement time is reached, the switch $S_2$ is operated. This operation of the switch $S_2$ is detected in step S30 of FIG. 11. A current stopwatch time ST of the stopwatch counting circuit 107 is set in the working register $W_1$ in step S31, and the CPU 100 determines in step S32 that the value of the lap number register L is "0", i.e., the lap measurement is performed for the first time. Therefore, the "1" is set in the register L in step S33, and the current stopwatch time ST set in the working register $w_1$ is stored as a first lap time in the lap memory ML designated by the lap number register L, i.e., in the lap memory M1 in step S34. Subsequently, the CPU 100 checks in step S35 whether the current lap time stored in the lap memory M1 is longer than 10 seconds. If Y (YES) in step S35, the lap prediction flag FL is set in step S36. In step S37, the current lap stored in the lap memory M1 is divided by 60 to calculate a time advanced by a minute hand **113*b* by one step, i.e., a drive period of the minute hand 113*b*, and the calculated drive period is set in the drive period register MS. If the CPU 100 determines in step S35 that the current lap is less than 10 seconds, the CPU 100** ends the switch processing assuming that the lap prediction operation need not be performed.

In the display processing performed, after the switch processing of the switch $S_2$ for storing the lap time is ended as described above, the stopwatch time ST is displayed on the liquid crystal display panel 121 in step S82, and the CPU 100 determines in steps S83 and S84 that the measurement flag FS and the lap prediction flag FL are already set, respectively, and determines in step S85 that a time corresponding to the drive period of the driver period register MS has not elapsed yet.

Once the lap obtained by the first lap measurement exceeds 10 seconds, the flow advances to step S85 each time the flow advances to the display processing, and the CPU 100 checks whether a time corresponding to the drive period of the driver period register MS has elapsed. If the time corresponding to the drive period has not elapsed, the flow returns to step S1, and the above operation is repeatedly performed. If, the elapsed time coincides with the drive period, the flow advances from step S85 to S86 each time a coincidence is detected. The hands 113 are moved stepwise in the forward direction in step S86, and the position of the hands 113 is stored in the hand position storage register PM in step S87. When the hands 113 reach a position indicating twelve o'clock, the value of the hand position storage register PM is returned to "0" in steps S88 and S89. When the first lap (lap stored in the lap memory M1) is 15 minutes as shown in FIG. 14, therefore, $15\times60\div60=15$ seconds are stored in the drive period register MS, and the minute hand 113*b* is sequentially driven from a state indicated by B in FIG. 14 by one step every 15 seconds to go around once in 15 minutes. As a result, the hands 113 indicates 1:00'. When 15 minutes or more have elapsed, e.g., 16 minutes have elapsed from the first lap measurement, the hands 113 are set as indicated by C in FIG. 14. Therefore (since the hands indicate a position after 1:00'), a user can recognize that a time period longer than the first lap time has elapsed after the first lap measurement. Since the hands 113 indicate a position before 1:00' until 15 minutes elapse, the user can recognize that the first lap is already measured and can predict a timing at which 15 minutes, i.e., the first lap time will elapse in the second lap measurement.

When the time elapses and the second measurement time is reached as described above, the switch $S_2$ is operated as in the first measurement. That is, this operation of the switch $S_2$ is detected in step S30 in FIG. 11, and a current stopwatch time ST is set in the working register $W_1$ in step S31. The CPU 100 determines in step S32 that the value of the lap number register L is no longer "0", and the flow advances to step S38. In step S38, a value obtained by multiplying the value of the lap number register L by 60 is set in the hand fast movement position storage register PA. As a result, since the value of the lap number register L is "1", position number data corresponding to 60 , i.e., one o'clock is set in the fast movement position storage register PA. In step S39, hand moving processing is performed. In this hand moving processing, the same processing as in FIG. 12 is executed. That is, until the position number data in the hand position storage register PM becomes equal to the position number data in the fast movement position storage register PA, i.e., the position of 1:00', the hands 113 are driven step by step and position number data obtained each time the hands are driven is set in the hand position storage register PM. When the position number data in the hand position storage register PM becomes equal to that in the fast movement position storage register PA, i.e., when the hands 113 indicate 1:00', the flow advances from the flow chart shown in FIG. 12 to step S40 shown in FIG. 11. In step S40, all the laps stored in the hand position storage register PM are added, and the addition result is set in the working register $w_2$. At this time, since the lap is stored in only the lap memory M1, the first lap is stored in the working register $W_2$. In step S41, the time of the working register $W_1$ is updated by a value obtained by subtracting the time of the working register $W_2$ from the current stopwatch time ST set in the working register $W_1$, and the flow advances to step S33. In step S33, execution of processing in which the second lap measurement is performed on the basis of value "2" of the lap number register L is stored. In step S34, the time of the working register $W_1$ is stored in the lap memory M2 as the second lap. Thereafter, the flow advances to step S37 via steps S35 and S36, a value obtained by dividing the current lap by 60 is set in the drive period register MS as a hand drive period in the next lap prediction, and the flow advances to display processing. In the display processing, a series of processing tasks are performed, e.g., the stopwatch time ST is displayed on the liquid crystal display panel 121. Thereafter, the switch input detecting processing (step S1) and the display processing (step S3) are repeatedly performed. In the display processing in step S3, as described above in steps S82 to S89, the hands 113 are driven forward by one step and the hand position is stored in the hand position storage register PM each time a current drive period is set in the drive period register MS. Therefore, in the state as indicated by C in FIG. 14, i.e., when the second lap measurement is executed 16 minutes after the first lap measurement, the hands 113 are returned fast from the state as shown in FIG. 14 to the state indicating 1:00'. Thereafter, the minute hand 113*b* of the hands 113 is moved at a rate of 16 min/lap, i.e., moved from 1:00' to 2:00' in 16 minutes. As a result, the fact that the lap measurement is already performed twice and the next lap measurement is the third time and that a timing of the third lap measurement is 16 minutes after the current time can be predicted. For example, if the timing of the third lap measurement of 16 minutes is reached in about 2'30", the state is as indicated by D in FIG. 14.

Thereafter, in the third, fourth, fifth, . . . , lap measurements, the switch $S_2$ is operated as in the first and second measurements, and an operation similar to that in the second lap measurement is performed. In a time interval between the lap measurements, as described above, the operation of predicting the next lap measurement timing and the like are performed.

In order to stop the measurement when a race or the like is finished, a user operates the switch $S_1$ as when the measurement is started. This operation of the switch $S_1$ is detected in step S21, and the CPU 100 determines in step S22 that the measurement flag FS is set. The measurement flag FS is reset in step S26, and the RS flip-flop 105 is reset to stop the measurement of the stopwatch time ST performed by the stopwatch counting circuit 107 in step S27.

In order to display each lap time stored in the lap storage unit RM in the above measurement mode on the liquid crystal display panel 121, the mode switch SM is operated in the measurement mode of "M=1" to set the read mode of "M=2". That is, this operation of the mode switch SM is detected in step S5 of FIG. 11, and the flow advances to step S11 via step S6. The CPU 100 determines in step S11 that the mode switch SM is operated in the measurement mode of "M=1" and determines in step S12 that the measurement flag FS is already reset. In step S13, "2" is set in the mode register M to set the read mode, and "1" is set in the memory designation register P. Subsequently, in step S14, a current time T from the time counting circuit 104 is converted into position number data corresponding to a hand position indicating the current time and set in the fast movement position storage register PA. In step S15, the hand moving processing shown in FIG. 12 is executed. In this processing, the hands 113 are moved fast until they indicate the current time T.

In the display processing, the CPU 100 determines in step S80 that the read mode of "M=2" is set and causes the liquid crystal display panel 121 to display the lap time stored in a lap memory designated by the value of the memory designation register P, i.e., the first lap time of the lap memory M1 in step S81. In step S72, the current time T is converted into position number data corresponding to a hand position indicating the current time and set in the fast movement position storage register PA. In step S73, the CPU 100 determines that the position number data of the fast movement position storage register PA is equal to that of the hand position storage register PM and ends the display processing.

In order to sequentially display the second lap, the third lap, . . . , on the liquid crystal display panel 121, the switch $S_1$ is operated in the read mode of "M=2". This operation of the switch $S_1$ is detected in step S46 of FIG. 11, and the value of the memory designation register P is incremented by one from "1" to the value of the lap number register L in step S47. In steps S48 and S49, processing in which the value of the register P is returned to "1" when it exceeds the maximum lap number is executed. In the display processing, in step S81, the lap time of the lap memory MP designated by the value of the memory designation register P is displayed on the liquid crystal display panel 121. In this case, the current time T is indicated by the hands 113 in step S72.

In order to switch the read mode to the timepiece mode, the mode switch SM is operated in the read mode of "M=2". This operation of the switch SM is detected in step S5, and the flow advances to step S16 via steps S6 and S11. In step S16, "0" is set in the mode register M to set the timepiece mode. In the display processing, the CPU 100 determines in step S70 that the timepiece mode is set and displays the current time T on the liquid crystal display panel 121 in step S71. In addition, the current time T is indicated by the hands in the processing executed from step S72.

Thereafter, the switch detecting processing (step S1) and the display processing (step S3) are repeatedly performed, and the current time T is digital-displayed on the panel 121 and indicated by the hands 113 each time the display processing is executed.

when the switches $S_1$ and $S_2$ are operated in the timepiece mode, the flow advances to the timepiece mode switch processing in step S50 of FIG. 11, and correction or the like of the current time T is performed.

As described above, according to the third embodiment of the present invention, a control means is provided to move the hands around once by a current lap time each time the lap measurement operation is executed. Therefore, a stopwatch which allows a user to easily predict the next lap measurement timing can be provided.

What is claimed is:

1. A stopwatch comprising:

a stepping motor;

hand mechanism means, having a hand, for rotating the hand by driving of said stepping motor;

time measuring means for starting a time measurement in accordance with a start command, and for measuring time from the start command to provide current measurement time information;

operation switching means for starting a time information determination operation during the time measurement performed by said time measuring means;

lap time measuring means for obtaining lap time data representative of a time duration between a preceding switching operation of said operation switching means and a current switching operation of said operation switching means; and stepping motor driving means for supplying a drive signal to said stepping motor for driving said stepping motor to rotate the hand of said hand mechanism means once on the basis of the lap time data obtained by said lap time measuring means.

2. A stopwatch according to claim 1, further comprising a second hand mechanism means, having a second hand, for rotating the second hand by a predetermined step upon one rotation of the hand of said hand mechanism means.

3. A stopwatch according to claim 1, wherein said hand mechanism means rotates the hand once by 60 steps.

4. A stopwatch according to claim 1, further comprising display means for displaying the measurement time information obtained by said time measuring means, and wherein said display means includes a display panel for optically displaying the measurement time information.

5. A stopwatch according to claim 1, further comprising a large number of lap time storing means for storing the lap time data obtained by the switching operation of said operation switching means.

6. A stopwatch according to claim 1, further comprising hand fast moving means for moving the hand of said hand mechanism means fast to a predetermined position before the time measurement is started by said time measuring means.

7. A stopwatch according to claim 6, wherein said hand fast moving means includes rotational direction determining means for determining whether the hand is to be rotated clockwise or counterclockwise.

8. A stopwatch according to claim 1, further comprising current time display means for causing said hand mechanism means to display a current time.

9. A stopwatch according to claim 1, further comprising hand moving means for moving the hand of said hand mechanism means to a predetermined position when said operation switching means is operated.

* * * * *